US009050543B2

(12) United States Patent
Barish

(10) Patent No.: US 9,050,543 B2
(45) Date of Patent: Jun. 9, 2015

(54) BUBBLE-PRODUCING DEVICES AND TOY MARKSMAN KIT INCLUDING SAME

(75) Inventor: Benjamin J. Barish, Tel-Aviv (IL)

(73) Assignee: Dan Barish, West Bloomfield, MI (US)

( * ) Notice: Subject to any disclaimer, the term of this patent is extended or adjusted under 35 U.S.C. 154(b) by 1605 days.

(21) Appl. No.: 12/292,211

(22) Filed: Nov. 13, 2008

(65) Prior Publication Data

US 2009/0124161 A1 May 14, 2009

Related U.S. Application Data

(60) Provisional application No. 61/064,169, filed on Feb. 20, 2008, provisional application No. 60/996,380, filed on Nov. 14, 2007.

(51) Int. Cl.
*A63H 33/28* (2006.01)
*F41B 9/00* (2006.01)

(52) U.S. Cl.
CPC ..... *A63H 33/28* (2013.01); *F41B 9/004* (2013.01)

(58) Field of Classification Search
CPC ..... A63H 33/28
USPC ..... 446/15–21
See application file for complete search history.

(56) References Cited

U.S. PATENT DOCUMENTS

| | | | | | |
|---|---|---|---|---|---|
| 2,560,582 | A * | 7/1951 | Limber | 446/18 |
| 2,832,173 | A * | 4/1958 | Winfield | 446/16 |
| 3,604,144 | A * | 9/1971 | Span | 446/17 |
| 3,775,898 | A * | 12/1973 | Kalish | 446/17 |
| 3,925,923 | A * | 12/1975 | La Fata et al. | 446/18 |
| 4,248,436 | A * | 2/1981 | Corrigan | 273/349 |
| 5,042,819 | A * | 8/1991 | LaFata | 273/349 |
| 5,701,879 | A * | 12/1997 | Johnson et al. | 124/69 |
| 2006/0094324 | A1 * | 5/2006 | Kelley | 446/15 |

* cited by examiner

*Primary Examiner* — Gene Kim
*Assistant Examiner* — Alyssa Hylinski

(57) ABSTRACT

A bubble-producing device includes a container for receiving a quantity of a bubble-forming liquid to a desired liquid level in the container; a bubble-forming loop moveable within the container to a lower position below the desired liquid level so as to be submerged in the liquid when received within the container, or to an upper position emerged from the liquid; and a controlled gas supply system for controlling the introduction of a gas (e.g. air) into the container effective: (a) first to move the bubble-forming loop from its lower position submerged in the bubble-forming liquid, to its upper position emerged from the bubble-forming liquid; and then (b) to discharge gas through the bubble-forming loop and thereby to produce a bubble therein. Embodiments are described wherein the bubbles are produced at a distance to serve as targets for a water gun, and wherein bubbles of different colors are produced.

7 Claims, 9 Drawing Sheets

BUBBLE-PRODUCING DEVICES AND TOY MARKSMAN KIT INCLUDING SAME

RELATED APPLICATION/S

This application claims the benefit of priority of U.S. Provisional Patent Applications Nos. 61/064,169 filed on Feb. 20, 2008 and 60/996,380 filed on Nov. 14, 2007. The contents of the above applications are incorporated by reference as if fully set forth herein.

FIELD AND BACKGROUND OF THE INVENTION

The present invention relates to novel bubble-producing devices for producing bubbles from a bubble-forming liquid, such as soapy water. The invention also relates to a kit including a toy gun, e.g., a toy water gun, and a novel bubble-producing device to produce bubble targets for the toy gun.

The production of bubbles is a fascinating phenomenon to view, and a wide variety of toys and other amusement devices have been developed based on this phenomenon. A simple type of bubble-forming device includes a loop carried at one end of a wand, which loop is dipped into a bubble-forming liquid (e.g., soapy water) and then waved through the air to generate a series of bubbles during each such operation. Various more complicated manually-driven devices, as well as electrically-driven devices, have also been developed which blow air through a loop, after having been dipped into a bubble-forming liquid, to produce a series of bubbles.

Colored soap bubbles are particularly fascinating to produce and to observe. A serious drawback in producing colored soap bubbles is the fact that, when the bubbles burst, they leave a stain which is sometimes difficult to remove. Recently, dyes have been developed capable of producing colored soap bubbles that do not leave stains. One form of such colored soap bubbles, called "Zubbles"™, has been named the "Innovation of the Year" for 2005 by Popular Science (December 2005 issue, Page 7); and Reader's Digest referred to it as one of the "Best Innovations" of the year in 2006.

New constructions of bubble-producing devices are continuously being developed to increase the amusement value of such devices, and also to simplify the construction of the devices for low-cost volume production.

OBJECTS AND BRIEF SUMMARY OF THE PRESENT INVENTION

An object of the present invention is to provide a novel bubble-producing device of a very simple construction which can be produced in volume and at low cost. Another object is to provide a bubble-producing device which permits a wide variety of bubble sizes, configurations, and/or colors to be conveniently produced. A still further object is to provide a novel bubble-producing device which can be operated from a remote location, spaced from the operator, so that the produced bubbles can be used as targets. Yet another object of the invention is to provide a kit including a hand-operated toy gun, and a bubble-producing device producing bubbles to serve as targets for the toy gun.

According to one broad aspect of the present invention, there is provided a bubble-producing device, comprising: a container for receiving a quantity of a bubble-forming liquid to a desired liquid level in the container; a bubble-forming loop moveable within the container to a lower position below the desired liquid level so as to be submerged in the liquid when received within n the container, or to an upper position emerged from the liquid; and a controlled gas (preferably air) supply system including a source of pressurized gas remotely located from said container and bubble-forming loop, a flexible supply line connecting said remotely-located source of pressurized gas to said container such as to permit moving said source of pressurized gas to different locations with respect to said container; and a control device proximal to said remotely-located source of pressurized gas for controlling the introduction of a gas from said source into the container effective (a) first to move the bubble-forming loop from its lower position submerged in the bubble-forming liquid, to its upper position emerged from the bubble-forming liquid; and then (b) to discharge gas through the bubble-forming loop and thereby to produce a bubble therein.

According to another aspect of the present invention, there is provided a bubble-forming device, comprising: a container divided into a plurality of sections each for receiving a quantity of a bubble-forming liquid to a desired liquid level in the respective section; a plurality of bubble-forming loops, each individually and selectively moveable to a lower position within one of the sections so as to be submerged in the bubble-forming liquid therein, and to an upper position emerged from the liquid in the respective section; at least one air nozzle aligned with the upper positions of at least one of the bubble-forming loops; and a control system including a source of pressurized air for selectively controlling the movements of the bubble-forming loops to their upper positions, and the discharge of air from the at least one air nozzle to produce a bubble in a selected bubble-forming loop when in its upper position.

In one described preferred embodiment, the plurality of bubble-forming loops are arrayed in alignment with each other and with one air nozzle, such that individual bubbles can be produced one at a time of the desired color. Other embodiments are described wherein the device further includes a plurality of nozzles, each aligned with one of the bubble-forming loops in their upper positions, the nozzles and bubble-forming loops being arranged in annular arrays, each nozzle being selectively actuatable to produce a plurality of differently-colored bubbles one at a time, or a plurality at a time.

According to further features in the described preferred embodiments of the invention, the device further comprises: a manually-actuated pump, such as a manually-squeezable bulb, introducing air into the container. The controlled gas supply system may also include a storage tank between the tank and the container for storing compressed air before introduced into the air container, the arrangement being such that a supply of compressed air is built-up in the storage for use in blowing bubbles in a convenient manually-controlled manner.

The controlled gas (e.g. air) supply system may further include a supply line of any desired length from the manual pump or storage tank to the container to permit remote operation of the bubble-producing device. This feature makes the device particularly useful for producing bubbles to serve as targets, e.g., for toy guns of the type described in my prior U.S. Pat. No. 6,123,229.

As will be described more particularly below, such features permit the operators to produce bubbles as and when desired and also to control the size of the bubbles, either where the operator is at the location of the bubble-producing device, or at a remote location therefrom.

According to a still further aspect of the invention, there is provided a bubble-forming device, comprising a container for receiving a quantity of a bubble-forming liquid to a desired liquid level in the container; a bubble-forming loop moveable within the container to a lower position below the desired liquid level so as to be submerged in the liquid when received within the container, or to an upper position emerged from the liquid; a storage tank for storing pressurized air, the storage tank having an inlet and an outlet; a manually-actuated pump connected to the inlet of the storage tank for pumping air into the storage to store pressurized air therein; and a control system between the outlet of the storage tank and the container effective for manually controlling the outlet of said storage tank such that the pressurized air stored within the storage tank is: (a) first to move the bubble-forming loop from its lower position submerged in the bubble-forming liquid, to its upper position emerged from the bubble-forming liquid; and then (b) to discharge gas through the bubble-forming loop and thereby to produce a bubble therein.

Further features and advantages of the invention will be apparent from the description below.

BRIEF DESCRIPTION OF THE DRAWINGS

The invention is herein described, by way of example only, with reference to the accompanying drawings, wherein.

It is to be understood that the foregoing drawings, and the description below, are provided primarily for purposes of facilitating understanding the conceptual aspects of the invention and possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

DESCRIPTION OF PREFERRED EMBODIMENTS

Figure 1:
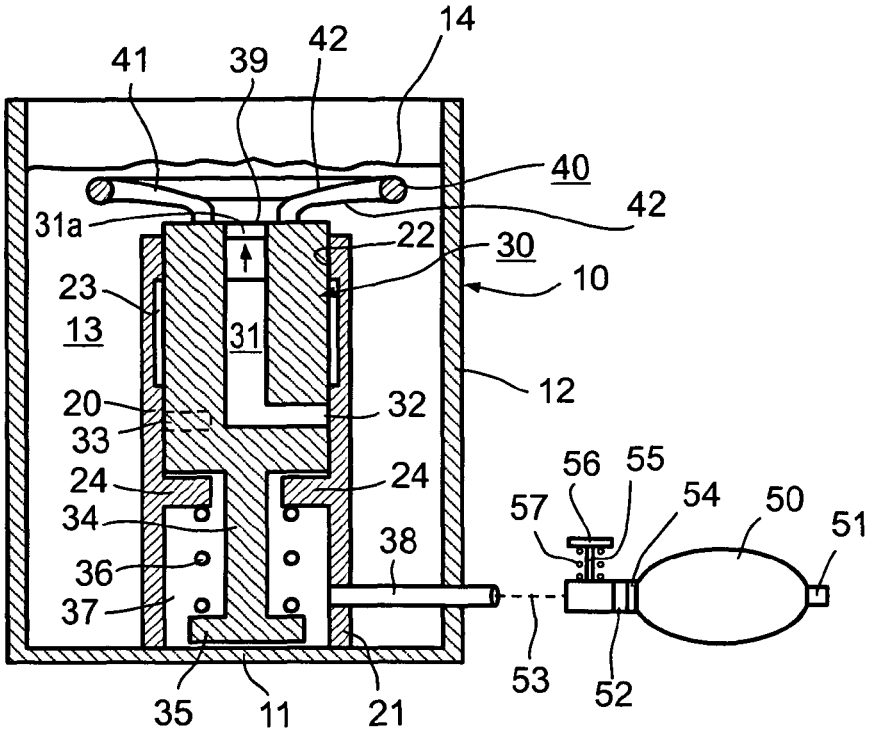
FIG. 1 is a sectional view illustrating one form of bubble-producing device constructed in accordance with the present invention.
Figure 2:
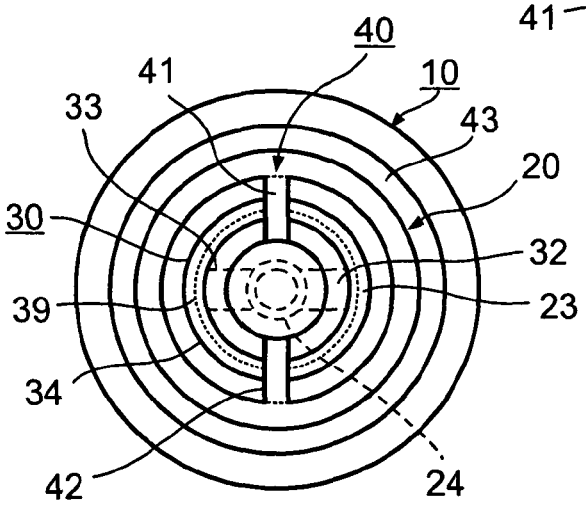
FIG. 2 is a top view of the device of FIG. 1.
Figure 3:
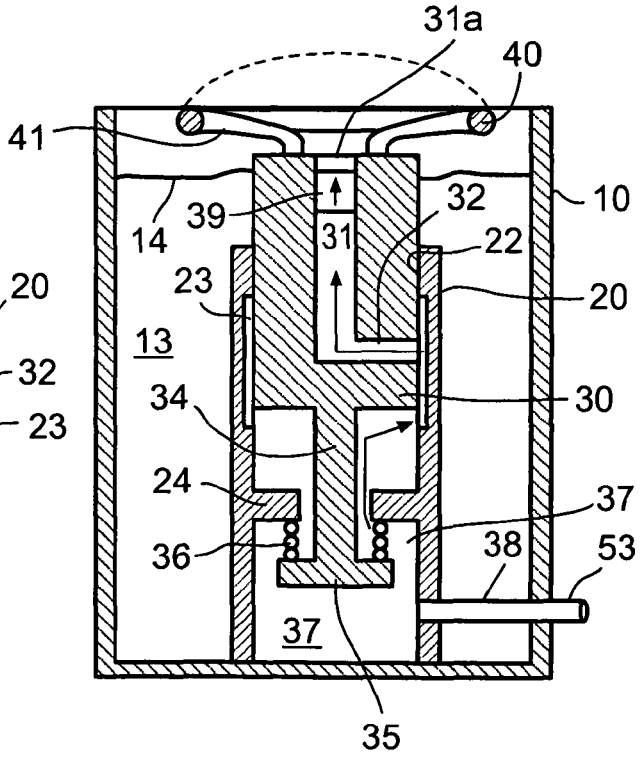
FIG. 3 illustrates the device of FIG. 1 in its actuated condition during the generation of a bubble.

The Bubble-Producing Device of FIGS. 1-3

The device illustrated in FIGS. 1-3 includes a container, generally designated 10, having a bottom wall 11, a side wall 12, and an open top, for receiving a quantity of a bubble-producing liquid 13 to a desired liquid level, indicated at 14. It further includes a cylinder 20 centrally located within container 10. The bottom 21 of cylinder 20 is closed by being fixed to bottom wall 11 of container 10. The upper end 22 of the side wall of cylinder 20 is open, but its inner surface is formed at its upper end with a circumferentially-extending slot 23. Cylinder 20 is further formed with an inwardly-extending shoulder 24 at an intermediate portion thereof below slot 23.

The device illustrated in FIGS. 1-3 further includes a piston, generally designated 30, displaceable within cylinder 20 from a normally lower position illustrated in FIG. 1, to an upper elevated position illustrated in FIG. 3. Piston 30 has an outer diameter equal to the inner diameter of the unslotted portion of the side wall of cylinder 20. A blind bore 31 is formed in the upper end of piston 30 extending axially from its outer face and communicating, at its lower end, with a pair of radially-extending bores 32, 33, as clearly seen in FIG. 2. The lower end of piston 20 is formed with a stem 34 extending between shoulder 24 of cylinder 20, and terminates in an enlarged head 35. A spring 36 is interposed between shoulder 24 of cylinder 20 and enlarged head 35 of the piston, to thereby urge the piston to its lowermost position as illustrated in FIG. 1, wherein the enlarged head 35 of the piston engages the inner surface of bottom wall 11 of container 10.

It will thus be seen that the lower surface of piston 30 defines, with the inner surface of bottom wall 11 of container 10, an expansible chamber 37 in which spring 36 urges piston 20 to its lowermost position. In this position, as illustrated in FIG. 1, radial bores 32, 33 of the piston are aligned with the lower unslotted inner surface of the cylinder 20, such that no communication is established between chamber 37 and central bore 31 of the piston via radial bores 32, 33. When pressurized air is introduced via an inlet conduit 38 into chamber 37, chamber 37 expands, whereby piston 20 moves upwardly until its radial bores 32, 33 become aligned with slot 23 in the inner surface of cylinder 20. When this occurs, air is forced out of the central bore 31 through an air nozzle 31*a* formed in the upper face of piston 30.

Figure 16:
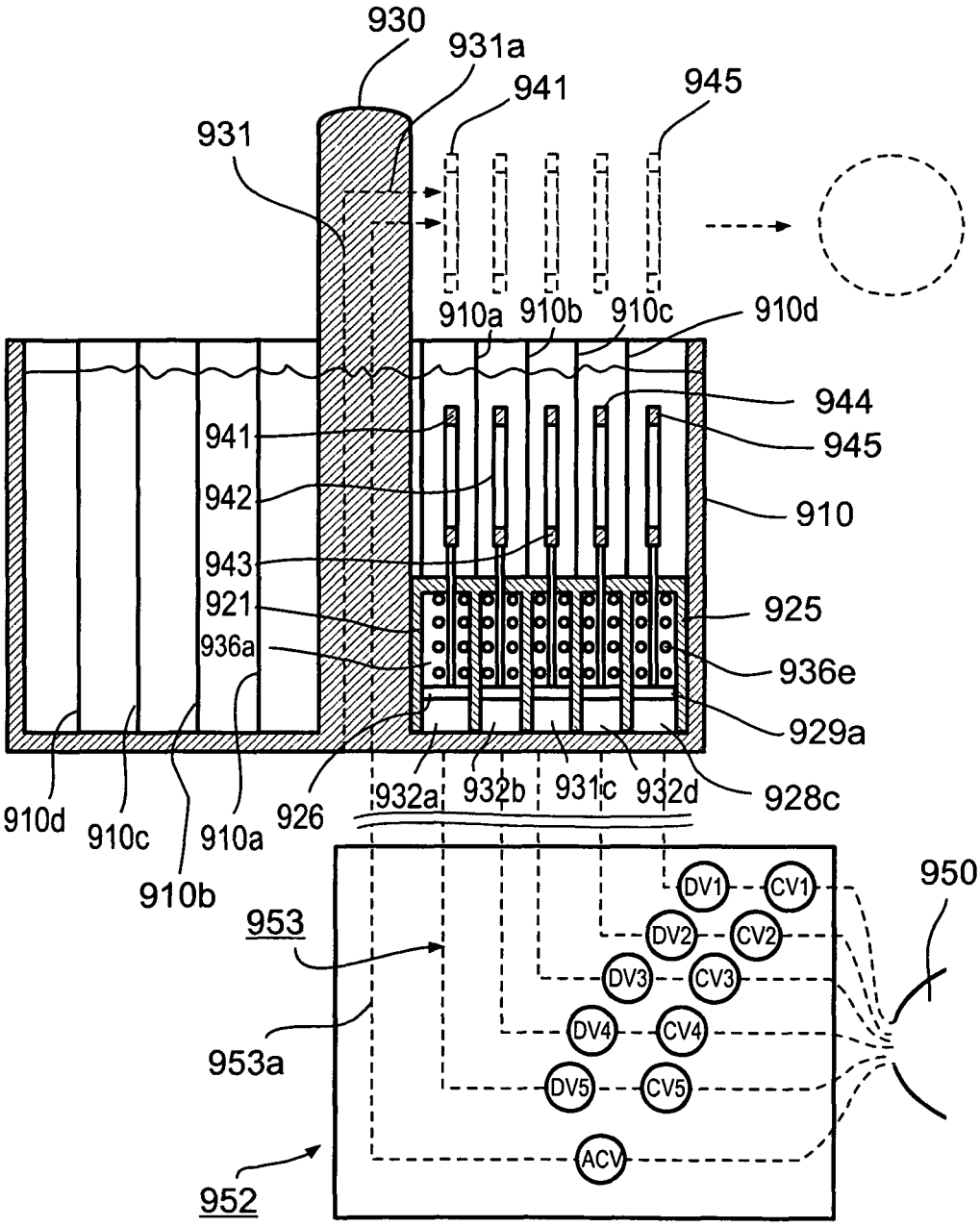
FIG. 16 illustrates another device in accordance with the present invention for providing multicolored bubbles.

In order to prevent liquid from entering bore 31 of piston 30, while the piston is in its lower position (below the liquid level 14) as illustrated in FIG. 1, nozzle 31*a*, at the upper end of bore 31, is provided with a one-way valve 39 effective to block the entry of liquid into bore 31, but to permit the discharge of air through nozzle 31*a* in the upper position of the piston, as illustrated in FIG. 3. Nozzle 31*a* may be flared outwardly (e.g., as shown in FIG. 16) so that the air issuing from it is fanned-out in a wide low-velocity stream, rather than in a narrow high-velocity stream.

Piston 30 carries a bubble-forming loop 40 via two radial arms 41, 42 secured at one of their ends to the loop, and at their opposite ends to the upper face of piston 30. Bubble-forming loop 40 circumscribes the cylinder 20 and is located to define an annular space 43 (FIG. 2), between it and the inner surface of container 10. The loop is normally in its lower position illustrated in FIG. 1, below the desired liquid level 14 in container 10, so as to be submerged in the liquid 13 within the container, but is movable by piston 30 to emerge from the liquid 13 and to be located above the liquid level 14, as shown in FIG. 3.

The illustrated bubble-producing device further includes a manually-actuated pump, in the form of a hand-squeezable bulb 50 (FIG. 1), for forcing air via inlet conduit 38 into expansible chamber 37, and thereby to raise the piston within the cylinder from the position illustrated in FIG. 1 to that illustrated in FIG. 3. Manual pump 50 includes a one-way valve 51 effective to permit the entry of ambient air into the interior of pump 50, but to block the exit of air therefrom. Squeezing pump 50 thus forces the air through the pump outlet 52 and, via a connecting tube 53 and inlet conduit 38, into the expansible chamber 37.

Outlet 52 also includes a one-way valve 54 which permits air from the bulb to flow via conduit 38 into the expansible chamber 37, but blocks the reverse flow of air, i.e., from the expansible chamber to the bulb. In addition, a drain valve 55, is provided downstream of valve 54. Drain valve 55 includes a stem having an enlarged head 56, urged by spring 57 to a closed position within the pump outlet 52, but is manually depressible to open the valve, and thereby to drain air from expansible chamber 37.

Manual pump 50 could be, for example, of a similar construction as in the bulb-type pumps commonly used in blood-pressure measuring devices of the inflatable-cuff type.

As will be described more particularly below, squeezing bulb 50 is effective: first to perform a raising operation, i.e., to raise piston 30 within cylinder 20, and the bubble-forming loop 50 coupled to the piston, from the lower position of the loop (FIG. 1) to its upper position (FIG. 3) emerging from the liquid; while further squeezing bulb 50 is effective to perform an inflating function, i.e., to force air through the loop 50 and to produce a bubble of the liquid adhering to the loop.

Operation of the FIGS. 1-3 Device

The manner in which the device illustrated in FIGS. 1-3 may be used to produce bubbles will be apparent from the above description. Thus, FIG. 1 illustrates the normal condition of the device, wherein piston 30 is in its lowermost position within cylinder 20, below slot 23 in the inner surface of the cylinder; and bubble-forming loop 40 is also in its lower position below the liquid level 14 so as to be submerged within the liquid 13 in container 10. The piston, and thereby also the loop, are normally retained in this lowered position by spring 36 interposed between inner shoulder 24 of cylinder 20, and enlarged head 35 of the piston. One-way valve 39 prevents the entry of liquid into passageway 31 of the piston.

When pump 50 is manually squeezed, it first forces air into chamber 37 below piston 30, and thereby raises the piston to its upper position illustrated in FIG. 3, wherein the bubble-forming loop 40 is above level 14 of the liquid 13. As loop 40 emerges from the liquid 13, piston 30 continues to rise thereby to align its radial bores 32, 33 with slot 23 formed in the inner surface of cylinder 20. When this occurs, the pressurized air fed into chamber 37 is forced through nozzle 31*a* of longitudinal bore 31 in piston 30 projecting through the upper end of the cylinder and aligned with the loop 40 so as to start the formation of a bubble within the loop. As pump 50 is continued to be squeezed, more air is passed into the bubble. The bubble thus enlarges and eventually breaks-off into a spherical configuration, as in a conventional loop-type bubble-producing device.

Bulb 50 may then be released, whereupon it refills with ambient air via one-way inlet valve 51. One-way valve 54 at the outlet end 52 of bulb 50 prevents air from entering the bulb from expansible chamber 37. However, spring 36 urges the piston downwardly in cylinder 20, thereby draining some of the air out of chamber 37 via slot 23 and openings 31, 32, 33, until radial bores 32, 33 of the piston again become disaligned with slot 23 on the inner surface of the cylinder. The pressurized condition of chamber 37 will retain the piston in its partially elevated position where its bores 32, 33 first become disaligned with slot 23 on the inner of the cylinder. In order to return the piston, and its loop 40, to the fully lowered positions as illustrated in FIG. 1, this can be done by depressing enlarged head 56 of drain valve 55 to drain chamber 37 of the pressurized air within that chamber.

It will be appreciated that bulb 50 may be manually squeezed a number of times while drain valve 55 is closed, first to raise piston 30, and the bubble-forming loop 40, to the raised condition illustrated in FIG. 3, and then to force air into the space within the loop to produce one or more bubbles. Each release of bulb 50, will lower piston 30 to disalign its radial bores 32, 33 with slot 23 formed in the inner surface of cylinder 20. Each subsequent squeeze of the bulb will produce another bubble or a series of bubbles if so desired. Whenever loop 40 is to be resubmerged in the liquid in order to replenish its supply of liquid, this may be done by operating drain valve 55. This will drain the air from expansible chamber 37 and thereby move the piston to its lowermost position illustrated in FIG. 1, wherein the loop is again submerged in the liquid.

It will thus be seen that bulb 50 alone effects both the raising operation and the inflating operation described above, and that controlling the squeeze pressure applied to the bulb, particularly during the inflating operation, controls both the size and frequency of the produced bubbles.

Hand-bulb 50 may be located adjacent to container 10 as shown in FIG. 1; alternatively, it or may be located at a distance from the container, by merely using a flexible tube 53 of the appropriate length connecting bulb 50 to expansible chamber 37 of the container. The illustrated device may thus be used for producing bubbles for entertainment or ornamental purposes at the location of the operator or at a distant location from the operator. In the latter case, the produced bubbles may serve as targets, e.g., for a water pistol, spongy ball projectiles, etc.

Figure 4:
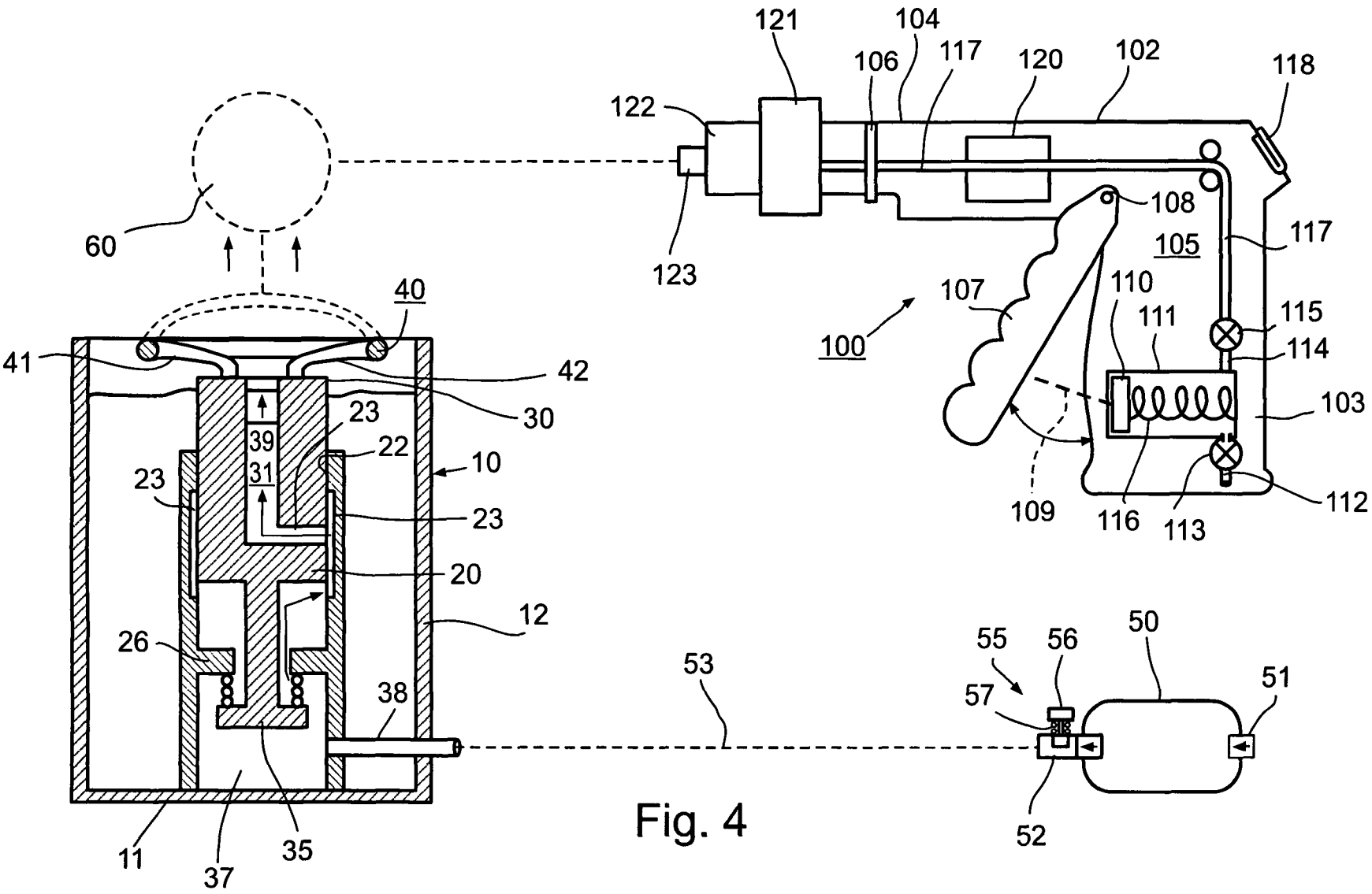
FIG. 4 illustrates the main components of a kit constructed in accordance with a preferred embodiment of the invention, namely one including a toy pistol, and a bubble-producing device in accordance with the present invention for producing bubbles to be used as targets for the toy pistol.

The Kit Illustrated in FIG. 4

FIG. 4 illustrates the components of a kit which includes a toy water pistol, generally designated 100, constructed as described in my U.S. Pat. No. 6,123,229, and a bubble-producing device constructed as described in the present application. To facilitate understanding, the various elements in the bubble-producing device illustrated in FIG. 4 are identified by the same reference numerals as in FIGS. 1-3, and the various elements of the toy water pistol 100 are identified by the same reference numerals as in U.S. Pat. No. 6,123,229, but increased by "100".

Thus, toy water pistol 100 illustrated in FIG. 4 includes a housing 102 formed with a handle 103 for grasping by the user, and a barrel 104 through which the water is to be discharged. The water is contained within an internal reservoir 105 defined by housing 102 up to a partition 106 provided in the housing adjacent to the discharge end of the barrel 104.

The illustrated toy water pistol further includes a hand operated pump for manually pumping the water from the water reservoir 105 through the discharge end of barrel 104. In this case, the pump is hand-operated by a lever 107 pivotally mounted at its upper end 108 to housing 102 and coupled at its lower end, by a coupling, shown schematically at 109, to a piston 110 movable within a cylinder 111. Cylinder 111 includes an inlet tube 112 leading to the bottom of the water reservoir within handle 105 and having a one-way valve 113 permitting water to flow only into the cylinder. The water is pumped out of the cylinder via an outlet tube 114 having a one-way valve 115 permitting the water to flow only out of the cylinder. A spring 116 within the cylinder urges piston 110 to its initial position illustrated in FIG. 4. Pivoting lever 107 towards handle 103 moves the piston to the opposite end of the cylinder to pump the water out of the cylinder and, via a feed tube 117 and other elements to be described below, through the discharge end of the barrel 104. A removable refill cap 118 permits refilling the water reservoir 105 within handle 103 and barrel 104 up to the partition 106.

The illustrated water pistol further includes a discharge control system for controlling the discharge from barrel 104 when the hand-pump is operated by pivoting lever 107. This discharge control system includes: a flow rate selector located within the pistol barrel 104, as schematically indicated by block 120 in FIG. 4; an expansible chamber at the discharge end of barrel 104, as schematically indicated by block 121; and a pressure-responsive valve controlling the outlet of expansible chamber 121, as schematically indicated by block 122. A presettable range selector schematically shown at 123, controls the velocity, and thereby the range, of the water discharge from the barrel 104.

Briefly, the operation of the illustrated water pistol is as follows: After the reservoir within handle 105 has been filled with water, the handle may be gripped and lever 107 may be pivoted towards the handle whenever it is desired to produce a water discharge from the barrel 104. Thus, when lever 107 is pivoted towards the handle, water within the reservoir is pumped by piston 110, moveable within cylinder 111, via one-way valve 115, 117 and flow rate selector 120, to expansible chamber 121. When the pressure within the chamber builds up to a predetermined value as preset by range selector 123, valve 122 opens with a snap-action to discharge a small quantity of water within the expansible chamber through the end of the barrel, thereby reducing the pressure within the expansible chamber to automatically close the valve. It will thus be seen that with each operation of lever 107, a short burst of water is ejected from the end of the barrel.

Further details of the construction and operation of the toy water pistol 100 illustrated in FIG. 4 are available from U.S. Pat. No. 6,123,229.

It will thus be seen that the toy water pistol 100 can be held in one hand, while the other hand holds bulb 150 to control the production of bubbles at a distance from the pistol to serve as targets for the short-discharges from the pistol.

Modifications in the Structure of the Bubble-Forming Loop

FIGS. 5-7*d* illustrate several modifications in the construction of the bubble-forming loop (40, FIGS. 1-3) carried by the piston. The other elements of the bubble-producing device may be constructed as described above with respect to FIGS. 1-3, and are therefore not shown.

Figure 5:
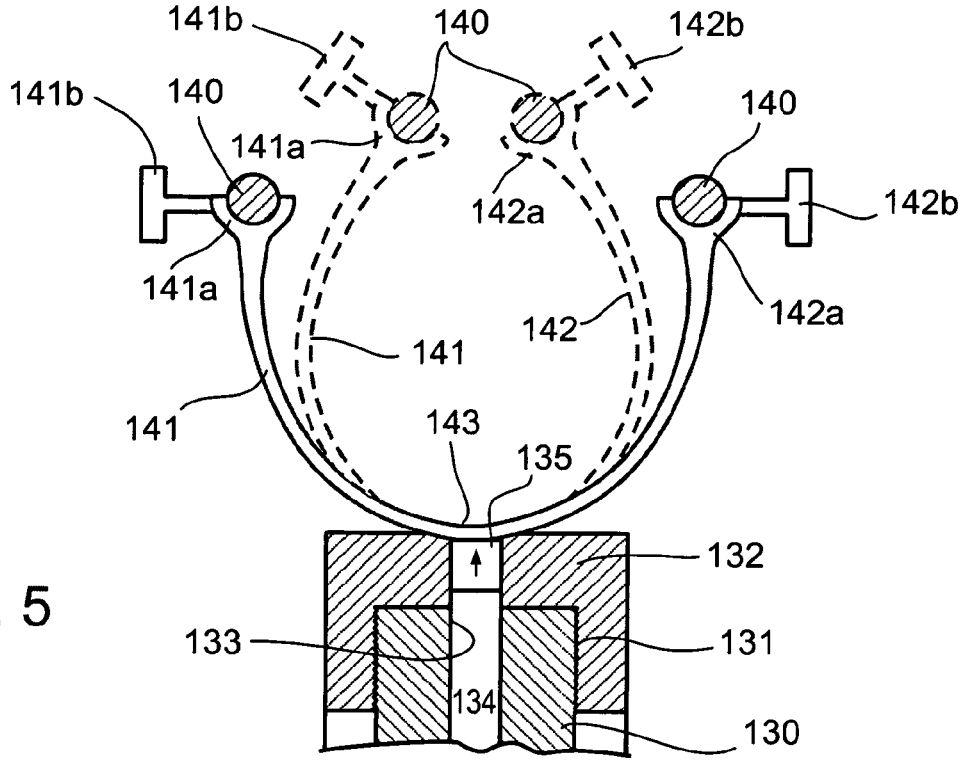
FIG. 5 illustrates a modification to enable generating bubbles of different sizes.

In the modifications illustrated in FIGS. 5-7*d*, the upper end of the piston is generally designated 130, whereas the upper end of the cylinder, within which the piston is received, is generally designated 120. As shown in FIG. 5, the upper end of the piston 130 is formed with external threads 131 for receiving an internally-threaded cap 132 carrying the bubble-forming loop, generally designated 140. Cap 132 is formed with a central opening 133 so as to be aligned with the axial bore 134 in piston 130 through which air is forced when the piston and bubble-forming loop 140 are moved to their upper positions above the water-level line (14, FIGS. 1-3).

In this case, the one-way outlet valve 135 (corresponding to 39, FIG. 1) is carried by cap 132, to permit the exit of air from longitudinal bore 134, but to block the entry of water into that bore in the lower position of the piston and loop as described above with respect to FIGS. 1-3.

In these modifications, the bubble-forming loop 140 is deformable to permit manually changing its configuration. Loop 140 is carried by a pair of deformable (preferably elastic) arms 141, 142 straddling the opposite sides of opening 133 formed centrally through cap 132. Elastic arms 141, 142 may be fixed to cap 132, or may be removably attachable thereto, e.g., by a bridging section 143 receivable in a snap-fastening manner within an annular recess formed centrally of the cap 132 around its opening 133.

The upper ends of the two elastic arms 141, 142 include channels, as shown at 141*a*, 142*a*, for receiving the lower end of bubble-forming loop 140. Assuming that the loop is originally of a circular configuration, the channels 141*a*, 142*a* will be engaged by the loop 140 at diametrically-opposite locations of the loop.

Loop 140 is deformable (preferably elastically deformable) so as to enable its opposite portions engaged by the channels 141*a*, 142*a* to be moved towards and away from each other in order to change the configuration of the loop. Thus, FIG. 5 illustrates the loop 140 in its original circular configuration in full lines, and in its inwardly-deformed configuration in broken lines. In order to facilitate manually changing the configuration of the loop, the channels 141*a*, 142*a* at the ends of elastic arms 141, 142 carry finger pieces 141*b*, 142*b*, engageable by the user's index finger and thumb for moving the opposite ends of the loop 140 towards or away from each other, as shown in FIG. 5.

Figure 7A:
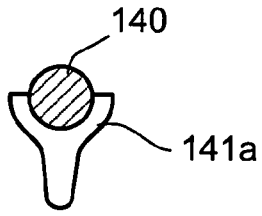
FIG. 7*a* is a fragmentary sectional view along lines a-a of FIG. 6.
Figure 6:
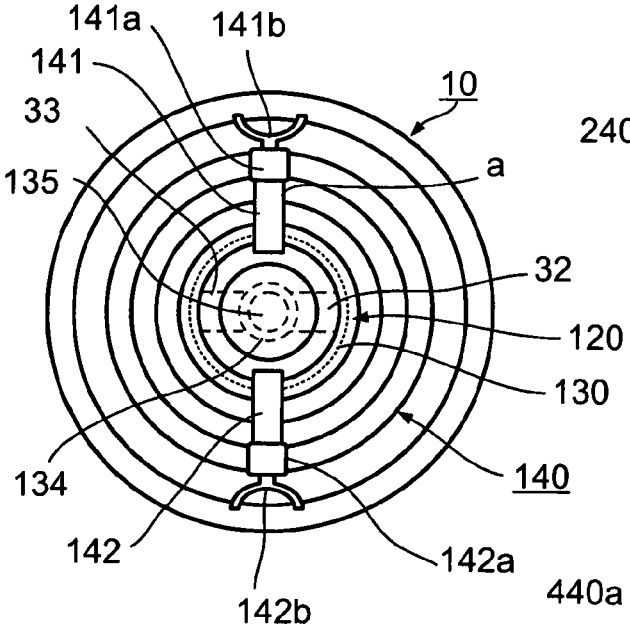
FIG. 6 is a top plan view of the device of FIG. 5.
Figure 7B:
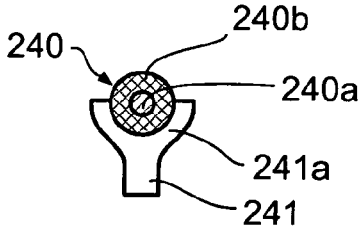
FIGS. 7*b*-7*d* illustrate other constructions of bubble-forming loops which may be made in accordance with the present invention.
Figure 7C:
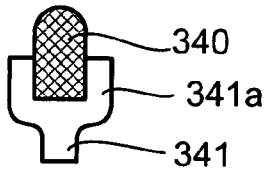

FIGS. 7*a*-7*d* illustrate examples of constructions that may be used for the bubble-forming loop 40, FIGS. 1-3. FIG. 7*a* illustrates the loop 140 received within channel 141*a* of elastic arm 141, made of an elastic metal, such as spring wire, enabling it to be easily deformed. In FIG. 7*b*, the loop is constructed of an inner metal wire core 240*a*, to provide elasticity, and an outer porous fabric layer 240*b* for retaining a supply of the liquid. Thus, channel 241*a* of elastic arm 241 engages the fabric sleeve 240*b* when mounting the loop. FIG. 7*c* illustrates the loop 340 constructed of a fabric material to retain a supply of the liquid, which loop is received within channel 341*a* of elastic arm 341.

Figure 7D:
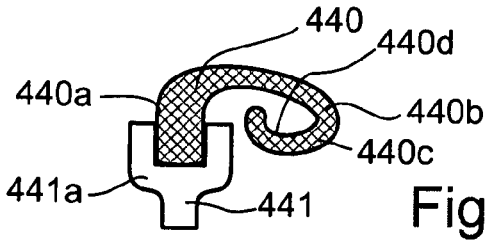

FIG. 7*d* illustrates a loop construction for retaining a substantial quantity of the liquid after immersion therein, so that a large number of bubbles can be produced between re-immersions of the loop. Thus, the loop 440 illustrated in FIG. 7*d*, is also made of a porous fabric material and includes a mounting section 440*a* for mounting in channel 441*a* of its respective elastic arm 441, terminating in an inverted C-section 440*b* defining an outer surface 440*c* for forming the bubble, and an inner reservoir 440*d* for holding a small quantity of the liquid after each immersion.

It will be appreciated that other constructions of the loop can be used, and that those illustrated in FIGS. 7*a*-7*d* can also be used in the embodiment of FIGS. 1-3.

It will thus be seen that the constructions illustrated in FIGS. 5-7*d* permit the bubble-forming loop to be changed in configuration in order to control the size of the bubble produced therein since the loop need not be of circular configuration for this purpose. These modifications may be also used to nip a bubble at any desired size, thereby also controlling the size of the produced bubble. When the loop and the arms are non-elastically deformable, they will retain their deformed shape upon the release of the finger-pressure; and when they are elastically deformable, they will return to their original shape.

The Bubble-Producing Devices of FIGS. 8-11

Figure 8:
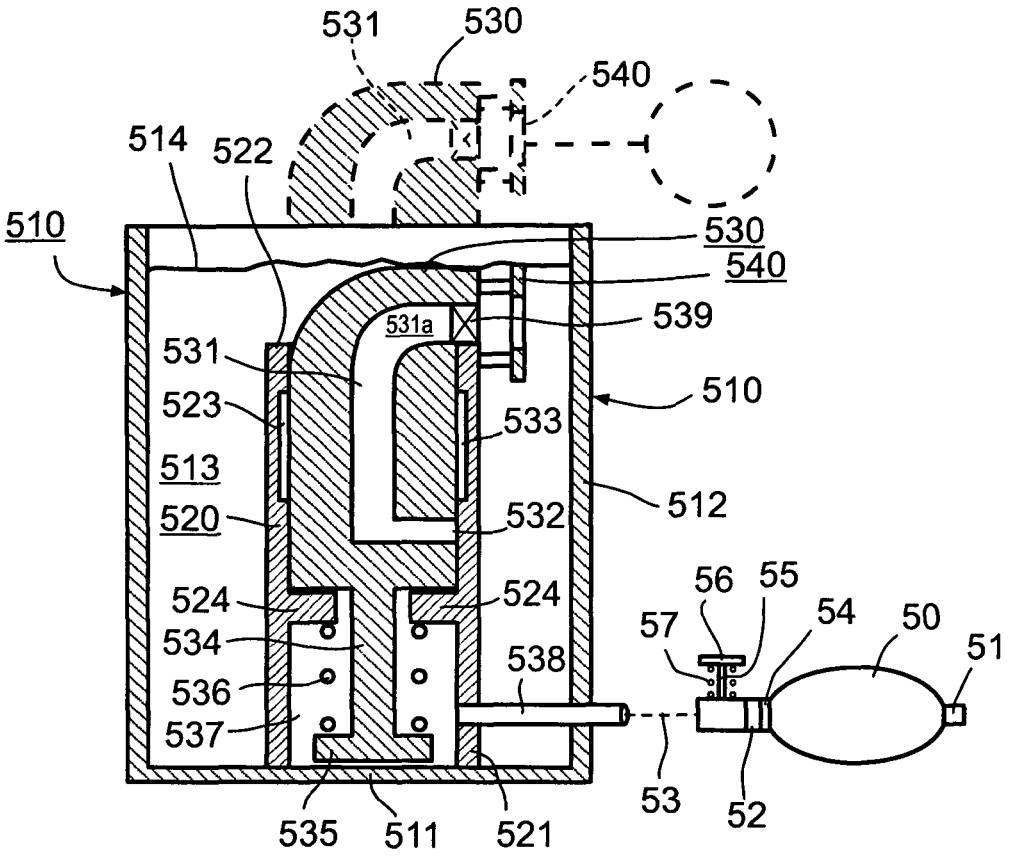
FIG. 8 illustrates a further embodiment of the invention wherein the bubble-forming loop is located vertically rather than horizontally.

FIG. 8 illustrates a bubble producing device similar to that of FIGS. 1-3, except that the bubble-forming loop is deployed vertically, rather than horizontally, in both the lower submerged position and the upper emerged position with respect to the bubble-forming liquid within the receptacle. To facilitate understanding, the parts in FIG. 5 corresponding to those in FIGS. 1-3 are identified by the same reference numerals, except increased by "500".

Thus, the bubble-producing device in FIG. 8 includes a container 510 having a bottom wall 511, a side wall 512, and an open top for receiving a quantity of the bubble-producing liquid 513 to a desired liquid level, indicated at 514. It further includes a cylinder 520 centrally located within the container 510. The bottom 521 of cylinder 520 is closed by the bottom wall 511 of the container, and the upper end 522 of the cylinder is opened, but its inner surface is formed at its upper end with a circumferentially-extending slot 523. Cylinder 520 is further formed with an inwardly-extending annular shoulder 524 at an intermediate portion thereof below slot 523.

The device illustrated in FIG. 8 also includes a piston 530 displaceable within cylinder 520 from a normally lower position indicated in full lines, to an upper elevated position illustrated in broken lines. An axially-extending bore 531 extending through the piston communicates with a radially-extending bore 532 at its lower end (corresponding to bore 32 in FIGS. 1-3) and, with another radially-extending bore 531*a* at its upper end. The latter serves as the outlet nozzle (corresponding to nozzle 31*a* in FIGS. 1-3) through which an air discharge is produced in the same manner as described above with respect to FIG. 1-3. Nozzle 531*a* in FIG. 8 is also closed by one-way valve 539, corresponding to valve 39 in FIGS. 1-3.

As further seen in FIG. 8, the bubble-forming loop 540 is supported from the outer end of piston 530 in a vertical position, as shown in full lines in FIG. 8, rather than in a horizontal position as in FIGS. 1-3. Bubble-forming loop 540 is thus maintained vertically in alignment with nozzle 531*a* in both the submerged position of the piston and loop as shown in full lines, as well as in the upper emerged position of the loop as shown in broken lines.

The manually-actuated pump 50 illustrated in FIG. 8 is of the same construction as in FIGS. 1-3; therefore for purposes of brevity, its parts are identified by the same reference numerals.

It will be seen that bubble-producing device illustrated in FIG. 8 operates in the same manner as described above with respect to FIGS. 1-3, except that the bubble-forming loop 540 is maintained in a vertical position, rather than in a horizontal position, in both the submerged and emerged positions of the loop.

Figure 9:
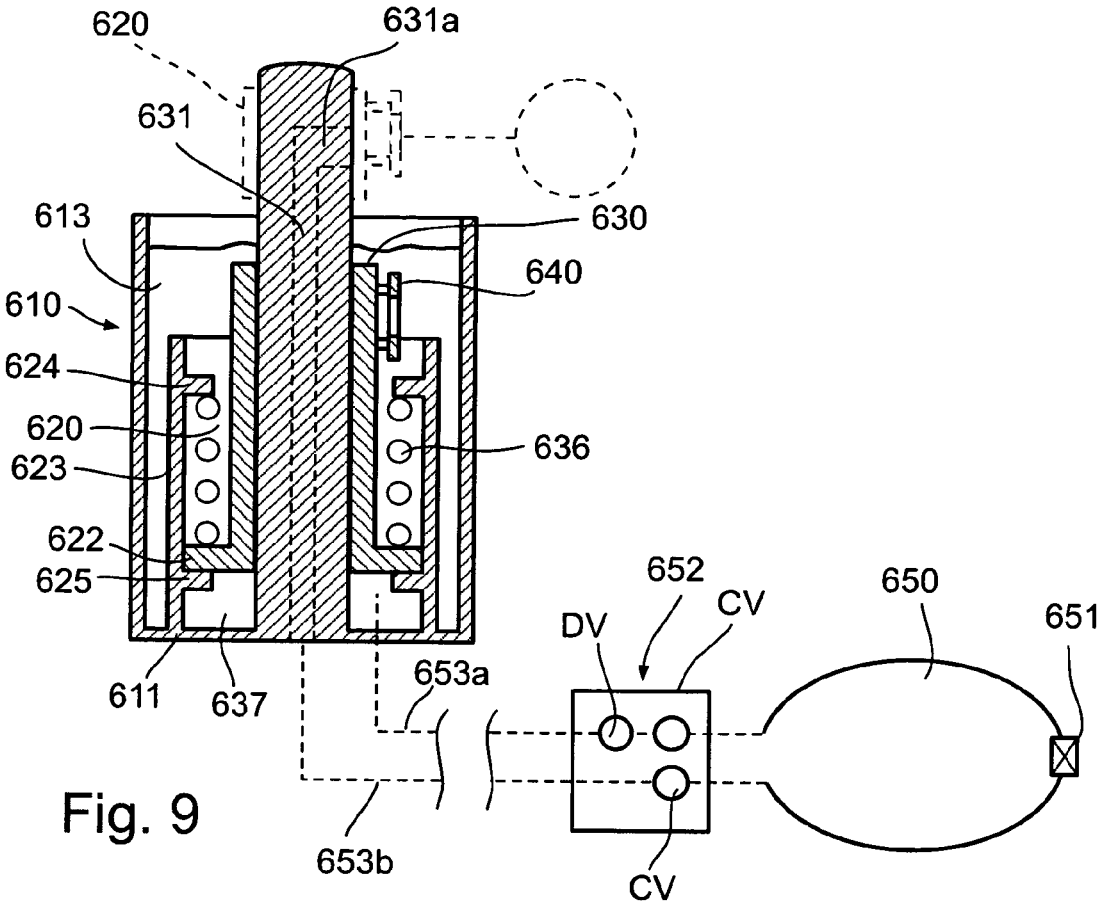
FIG. 9 illustrates a still further embodiment of the invention provided with a control panel having another arrangement of manual controls to facilitate the bubble size and/or frequency of bubble production.

FIG. 9 illustrates another construction of bubble-producing device in accordance with the present invention, also including a vertically-oriented bubble-forming loop 640, but a different control for raising and lowering the loop with respect to the bubble-forming liquid 613 within the container 610. The device illustrated in FIG. 9, however, includes one control for submerging and emerging the bubble-forming loop, and another control for forcing air through the emerged loop, rather than a single control for both functions as in FIGS. 1-3. To facilitate understanding, the elements in FIG. 9 which generally correspond to the elements in FIGS. 1-3 are identified by the same reference numerals, but increased by "600".

In the construction illustrated in FIG. 9, the bubble-forming loop 640 is carried by a cylinder 620 which is movably mounted with respect to a piston or stem 630 fixed to the bottom wall of container 610. Piston 630 thus serves as a fixed guide for the upward and downward movements of cylinder 620.

The movements of the bubble-forming loop 640 are controlled by the pressure within an expansible chamber 637 defined by the bottom wall 611 of container 610 and an outwardly-extending flange 622 formed at the lower end of movable cylinder 620. The outer surface of flange 622 engages the inner surface of another cylinder 623 fixed to the bottom wall 611 of the container. Movable cylinder 620, and therefore the bubble-forming loop 640 carried thereby, are urged to their lower position by a coiled spring 636 interposed between flange 622 on movable cylinder 620, and another flange 624 fixed at the upper end of the fixed cylinder 623. The lower position of movable cylinder 620, as well as of the bubble-forming loop 640 carried at its upper end, is fixed by another flange 625 at the lower end of the fixed cylinder 623. Thus, as the pressure in expansible chamber 637 increases, movable cylinder 620 moves upwardly, against spring 636, and carries with it the bubble-forming loop 640. This movement of movable cylinder 620 is guided by the central piston 630 fixed to the bottom wall 621 of the container.

The air discharge directed towards the bubble-forming loop 640, when in its upper position, is effected via bore 631 extending axially of fixed piston 630 and terminating at its upper end in a nozzle 631*a* oriented radially so as to direct the air discharge towards the bubble-forming loop 640.

It will thus be seen that in the FIG. 9 device, there are two controls for the air introduced via the manually-actuated pump 650 in order to produce a bubble. One control controls the air introduced into expansible chamber 637 to cause the bubble-forming loop 640 to emerge from the liquid 613 within container 610; and the other controls the air introduced into bore 631 of piston 630 to produce a discharge of air towards the bubble-forming loop when in its emerged position.

Manual pump 650 has a one-way valve 651 at one end permitting only the entry of air into the pump. The air outletted from the pump passes through a control panel, generally designated 652, which controls the air through one line 653*a* to expansible chamber 637, or to another line 653*b* to bore 631 within the fixed piston 630 and its nozzle 631*a*. For this purpose, control panel 652 includes a control valve CV and a drain valve DV in line 653*a* to the expansible chamber 637; and further includes a second control valve CV in line 653*b* leading to the air nozzle 631*a* at the upper end of piston 630.

When it is desired to produce bubbles, control valve CV in line 653*a* is manually actuated to direct air from pump 650 into expansible chamber 637 to raise the bubble-forming loop 640 to its emerged position shown in broken lines in FIG. 9. Control valve CV in line 653*b* is then manually actuated to introduce air from pump 650 via line 653*b* to nozzle 631*a*, which directs the air to the bubble-forming loop 640. It will be seen that the size and frequency of the bubbles so produced can be controlled by manipulating manual control valve CV in line 653*b*. Whenever it is desired to re-submerge the bubble-forming loop 640, drain valve DV in line 653*a* is manually opened to vent the interior of expansible chamber 637 to the atmosphere, thereby permitting the spring 636 to lower the bubble-forming loop 640 into the bubble-forming liquid.

Figure 10:
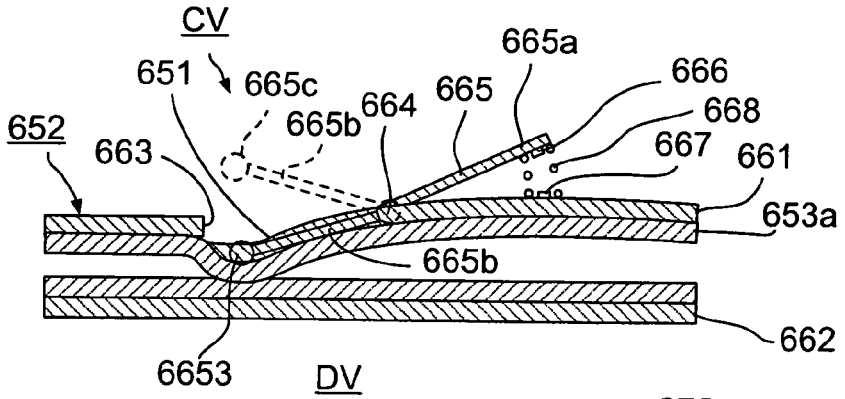
FIG. 10 illustrates the structure of a control valve in the control panel of FIG. 9.
Figure 11:
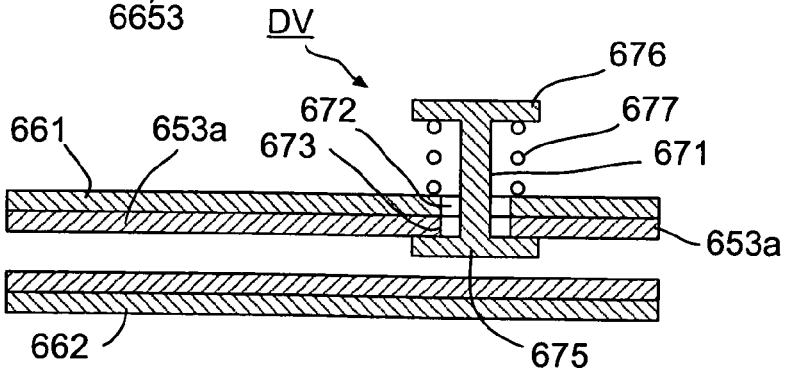
FIG. 11 illustrates the structure of a drain valve in the control panel of FIG. 9.

FIG. 10 illustrates an example of the structure of control valve CV in lines 653*a* and 653*b*; whereas FIG. 11 illustrates a structure for the drain valve DV in line 653*a*.

Thus, as shown in FIG. 10, line 653*a* is in the form of a flexible tube passing between plates 661 and 662 of the control panel 652. The upper plates 661 is formed with an opening 663 aligned with tube 653*a*, and is further formed with a pivotal mounting 664 on the upstream side of opening 663 for pivotally mounting a lever 665, having an outer end 665*a* extending outwardly of panel 661 and an inner end 665*b* extending inwardly, through opening 663, and terminating in a bead 665*c*. The under surface of the outer section 665*a* of lever 665, and the upper surface of panel 661 are formed with aligned pins 666, 667, for receiving a coiled spring 668.

Coiled spring 668 normally urges lever 665 to the closed position illustrated in full lines in FIG. 10, wherein its beaded end 665*c* is pressed firmly against tube 653*a* to thereby block the flow of air therethrough to the expansible chamber 637. Whenever it is desired to pass air into the expansible chamber, the external portion 665*a* of lever 665 is manually pressed downwardly, to thereby pivot portion 665*b* clockwise, to the open position of the control valve, thereby permitting the air to flow from the pump 650 to the expansible chamber 637 via tube 653*a*.

It will be appreciated that control valve CV in line 653*b*, controlling the supply of air to the nozzle 631*a* for producing the bubble, is of a similar construction, and therefore would also normally be in its closed position, but openable by depressing the external portion 665*a* of lever 665.

Drain valve DV in line 653*a* could be of a similar construction as illustrated in FIG. 1. When depressed, it vents the expansible chamber 637 to the atmosphere, thereby permitting the spring 636 to return the bubble-forming loop 640 to its lowered submerged position. As shown in FIG. 9, drain valve DV in control line 653*a* is downstream of the control valve CV in line 653*a* so that it controls the venting of the expansible chamber when the latter control valve CV is closed.

As shown in FIG. 11, drain valve DV includes a stem 671 passing through an enlarged opening 672 formed in the upper control plate 661, and another opening 673 formed in tube 653*a*. The lower end of stem 671 carries a valve member 675 sufficiently flexible so that it can be manually forced through the two openings 672 and 673, and is of sufficiently large size so that it completely covers the inner surface of the tube circumscribing opening 673. The outer end of stem 671 carries a finger-piece 676. A coiled spring 677 is interposed between finger-piece 676 and the outer surface of plate 661 to firmly bias valve member 675 to its closed condition as illustrated in FIG. 11.

Valve member 675 of drain valve DV is normally in its closed position as illustrated in FIG. 11, which closed condition is enhanced by any pressure within flexible tube 653*a*. Whenever it is desired to open the drain valve DV, finger-piece 676 is depressed, moving valve member 675 to its open condition with respect to opening 673 in tube 653*a*, and thereby venting the interior of expansible chamber 637 to the atmosphere. When this occurs, spring 636 returns the bubble-forming loop 640 to its lower submerged position in the bubble-forming liquid within container 610.

The operation of the bubble-producing device of FIG. 9 will be apparent from the above description. Thus, in the illustrated normally closed conditions of the two control valves CV and of drain valve DV, they block the introduction of air from pump 650 into expansible chamber 637 and also into bore 631 in piston 630 leading to nozzle 631*a*.

Whenever it is desired to produce bubbles, pump 650 is manually squeezed with one hand, and control valve CV in line 653*a* is manually opened with the other hand by depressing the external portion 665*a* of lever 665 downwardly against spring 666. This opens tube 653*a* for the introduction of air from pump 650 into expansible chamber 637, thereby raising cylinder 620 and the bubble-forming loop 640 carried at its upper end. Control valve CV in line 653*a* may then be released to return to its closed condition. Drain valve DV in line 653*a* remains in its normally closed condition.

When the bubble-forming loop 640 has thus been moved to its upper, emerged condition, as show in broken lines in FIG. 9, control valve CV in line 653*b* is manually opened to introduce air from pump 650 via bore 631 in piston 630 to produce a discharge of air via nozzle 631*a* in the direction of loop 640, thereby producing a bubble in the loop. As indicated above, the size and frequency of the produced bubbles can be controlled by manually controlling not only pump 650, but also control valve CV in line 653*b*. That is, depressing lever 665 with a light touch produces a restricted flow of air to nozzle 631*a* and, if this is done for a relatively long period of time, a relatively large sized bubble is likely to be produced. On the other hand, depressing lever 665 repeatedly with a heavy touch is more likely to produce a series of relatively small bubbles.

Thus, the size and/or frequency of the bubbles can be controlled by the "lightness" of the touch applied to control valve CV in line 653*b*, and with the "lightness" of the squeeze applied to pump 650. For example, the user may develop the proper coordination in the lightness of the touch applied to the control valve. and the lightness of the squeeze simultaneously applied to pump 650, to produces bubbles of an appropriate size for use as targets, of a maximum size for competing with others, etc.

Whenever it is desired to re-submerge loop 640 into the bubble-forming liquid within container 610, drain valve DV is opened to drain expansible chamber 637 to the atmosphere, thereby causing spring 636 to return the loop 640 to its lower submerged condition.

The bubble-producing solution used may be any one of the commercially-available liquids. For example, it may include not only a liquid detergent and water, but also glycerine to reduce water evaporation and thereby lengthen the bubble life. It may also include a polymer, such as the one supplied by Spinmaster Toys of Toronto, Canada, under the trademark "Catch-A-Bubble", which reacts with the air to harden in three or four seconds after a bubble is blown. The bubble-producing solution may also include a color dye, such as one of the recently-developed dyes referred to above, to produce colored bubbles without staining.

The Bubble-Producing Devices of FIGS. 12-16

FIGS. 12-16 illustrate several constructions of bubble-producing devices particularly useful with colored dyes for producing various patterns or combinations of colored bubbles. The devices of FIGS. 12-16 are similar in structure to those of FIGS. 9-11, except that they include a plurality of bubble-forming loops each selectively submergible in separate sections of the container containing different colored bubble-forming liquids.

Figure 12:
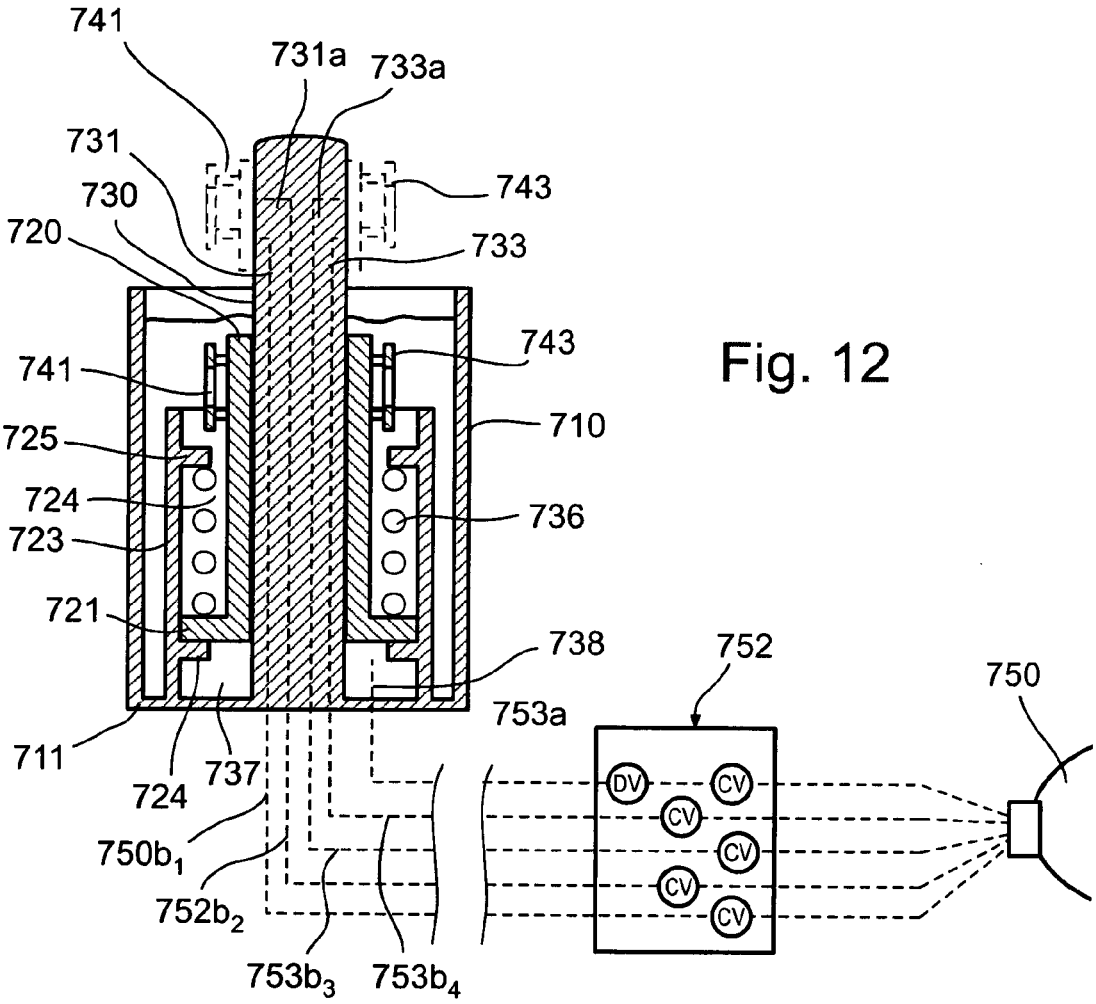
FIG. 12 illustrates another embodiment of the invention particularly useful for producing differently-colored bubbles.
Figure 13:
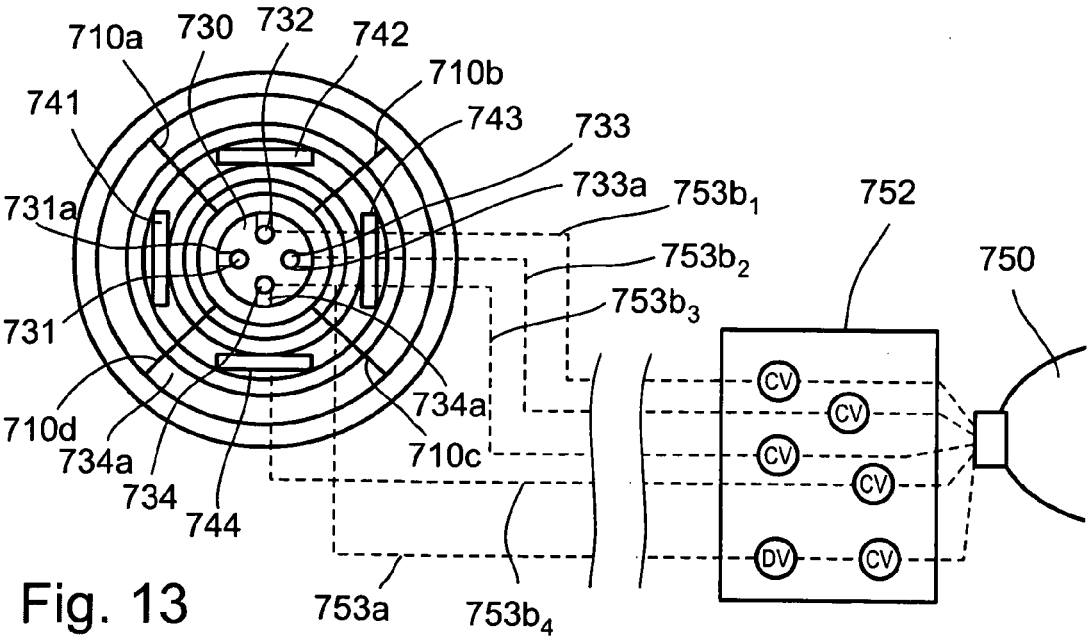
FIG. 13 is a top plan view of the device of FIG. 12.

Thus, the device of FIGS. 12 and 13 is of similar construction as that illustrated in FIG. 9, including a receptacle 710 having a central stem or piston 730 fixed to the bottom of the receptacle centrally thereof, and a movable cylinder 720 slidably received over stem 730. A fixed cylinder 723 is coaxially mounted with respect to cylinder 720 and stem 730.

The bottom of movable cylinder 720 is formed with an enlarged head 721 slidable within fixed cylinder 723 between a lower annular shoulder 724 and an upper annular shoulder 725 integrally formed in the inner face of fixed cylinder 723. The outer diameter of head 721 of movable cylinder 720 is equal to the inner diameter of fixed cylinder 723 so as to define an expansible chamber 737. A coiled spring 736 between head 721 of movable cylinder 720 and shoulder 725 of fixed cylinder 723 urges cylinder 720 to its lowermost position, thereby contracting expansible chamber 737. An air port 738 is formed in the bottom wall of container 710 and is connected to tube 753*a* leading to the manual pump 750 via a control panel 752. Thus, when pressurized air is introduced into expansible chamber 737, cylinder 720 is raised to an upper position; and when the pressure within chamber 737 is drained to the atmosphere, spring 736 returns the cylinder to its lower position.

Container 710 is divided into four sections by radially-extending partitions 710*a*-710*d*, as shown in FIG. 13. Each of the sections defined by the partitions is to receive a bubble-forming liquid of a selected color. Thus, the device of FIGS. 12 and 13 can produce bubbles of four different colors.

Cylinder 720, which is moved to its upper position by introducing pressurized air into expansible chamber 737 as described above, carries four bubble-forming loops 741-744, as shown particularly in FIG. 13. Thus, all the loops are moveable together with cylinder 720, to their lower positions shown in full lines in FIG. 12, or to their upper positions shown in broken lines in FIG. 12. Accordingly, when cylinder 720 is moved to its raised position by pressurizing expansible chamber 737, the four bubble-forming loops 741-744, each coated with its respective colored bubble-forming liquid, is raised to its upper emerged position, as shown in broken lines in FIG. 12.

Central fixed stem 730, which also serves as a fixed piston with respect to the moveable cylinder 720, is formed with four axial bores 731-734, each terminating at its upper end in a radially-extending nozzle 731*a*-734*a*. Each nozzle is in alignment with one of the bubble-forming loops 741-744 when in their raised positions. Each bore 731-734 is connected via a tube 753$b_1$-753$b_4$, and a control panel 752, to a source of pressurized air, in this case manual pump 750.

Tube 753*a*, connected to the expansible chamber 737, is coupled to pump 750 via a control valve CV and a drain valve DV in the control panel 752. The control valve and drain valve may be of the constructions described above with respect to FIGS. 10 and 11, respectively. Control valve CV in tube 753*a* is normally closed, to prevent pressurized air from entering expansible chamber 737, but is opened upon manual depression of that valve, to thereby raise sleeve 720, and all the bubble-forming loops 731-734 carried thereby, to the upper position of the loops above the liquid level within their respective sections of container 710. Drain valve DV in tube 753*a* is also normally closed when chamber 737 is to be contracted by spring 736, and manually opened to drain chamber 737 and thereby expand that chamber by the action of spring 736.

The four nozzles 731*a*-734*a* of axial bores 731-734 in stem 730 are all connected, via tubes 753$b_1$-753$b_4$ and their control valves CV of the control panel 752, to pump 750. These control valves are also normally closed, but may be selectively opened manually, as described above with respect to FIG. 10, to pass air from the pump 750 and the respective line 753$b_1$-753$b_4$, to their respective bores 731-734 and out through their respective nozzles 731*a*-734*a* aligned with the four bubble-forming loops 741-744 when in their upper positions, as shown in broken lines in FIG. 12.

It will thus be seen that, when four different colored bubble liquids are received within the four sections of the receptacle as defined by the four radial partitions 710*a*-710*d*, the four bubble-forming loops 741-744 are submerged in the bubble-forming liquid of the color in the respective section. When one or more colored bubbles are to be produced, valve CV in line 753*a* is first manually opened, and then the respective control valve(s) $CVb_1$-$CVb_4$ are manually opened to thereby pass air from pump 750 to the respective nozzle(s) 731*a*-734*a* in bores 731-734 towards the bubble-forming loop 741-744 in alignment with the respective nozzle.

After raising the four bubble-forming loops 741-744 to their upper positions emerged from the colored bubble-forming liquid in their respective sections, one or more colored bubbles may be produced by merely depressing the respective control valve CV in lines 753$_1$-753$b_4$ of the control panel 752. The size of the colored bubble, as well as the order and frequency at which the colored bubbles are produced, can be effected by controlling the respective control valves and/or pump 750 as described above.

When it is desired to re-submerge the bubble-forming loops 741-744, it is only necessary to depress drain valve DV in line 753*a*, which vents the pressurized air in expansible chamber 737 to the atmosphere.

Figure 14:
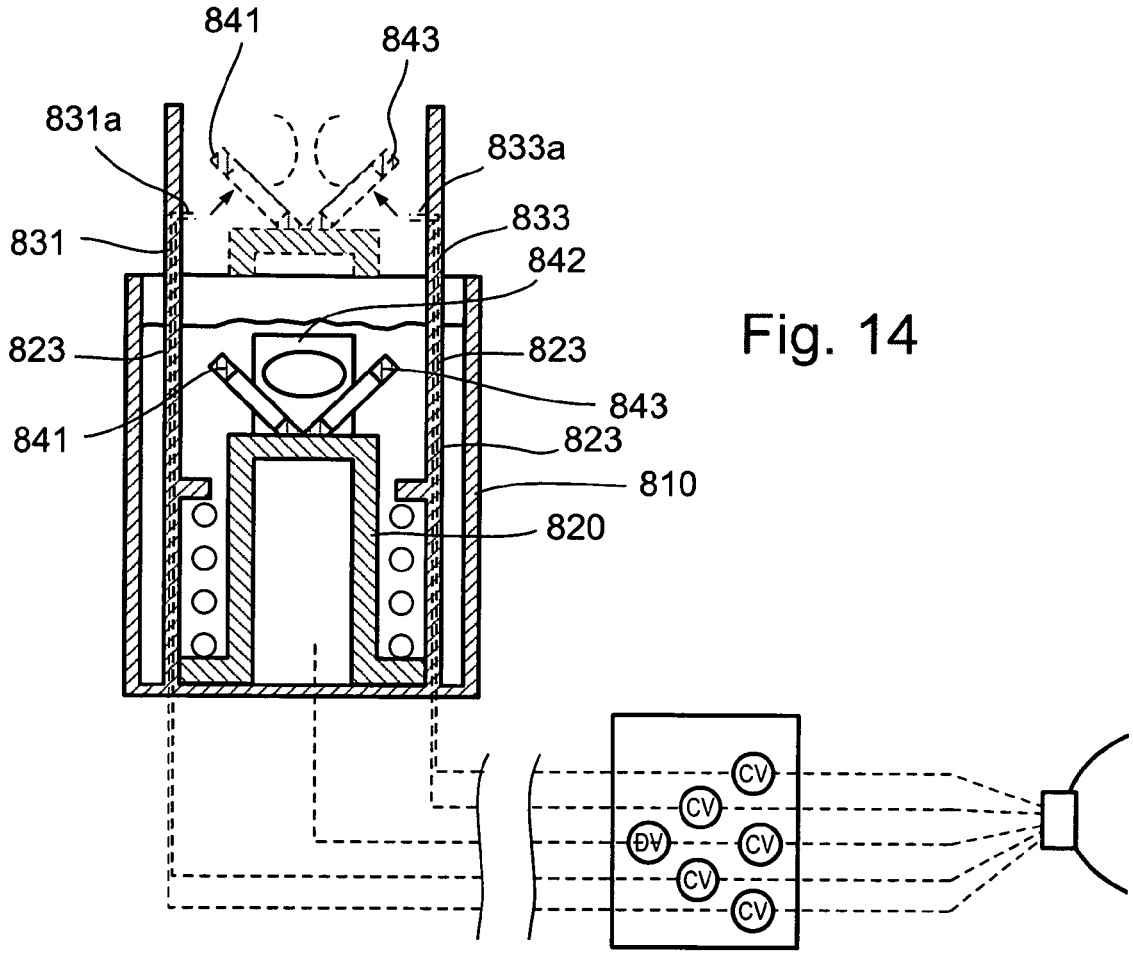
FIG. 14 illustrates a variation in the construction of the bubble-producing device of FIG. 12.
Figure 15:
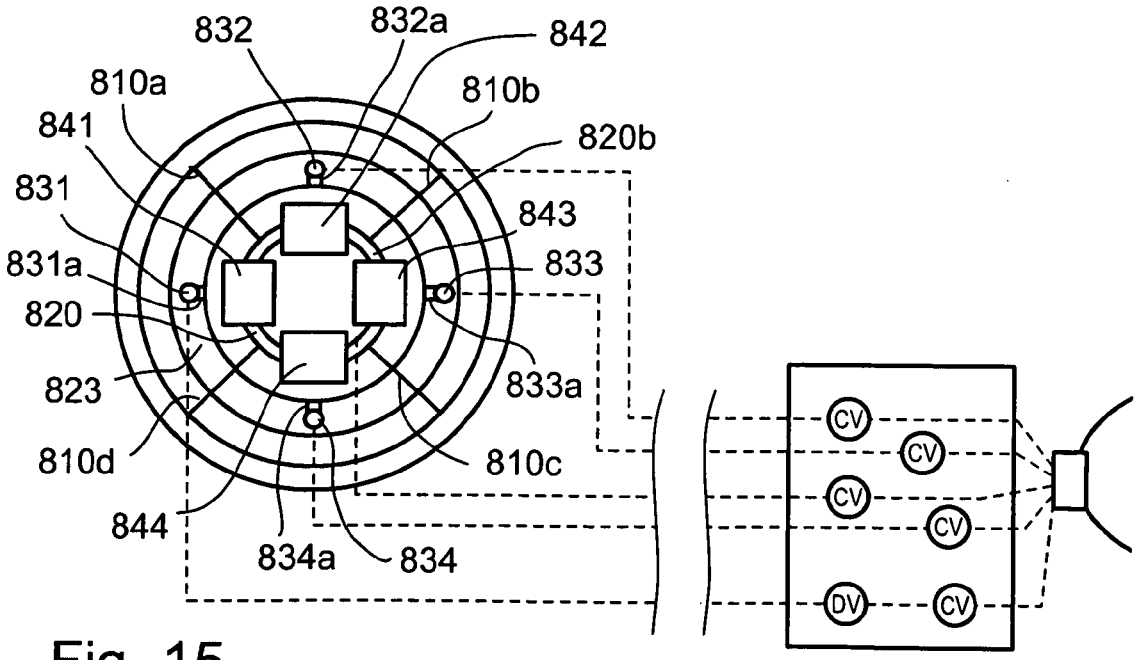
FIG. 15 is a plan view of the device of FIG. 14.

FIGS. 14 and 15 illustrate a device similar to that of FIGS. 12 and 13, in that it also includes an annular array of air nozzles 831*a*-834*a* aligned with an annular array of bubble-forming loops 841-844 in the upper positions of the loop. Whereas in FIGS. 12 and 13 the annular array of nozzles are located within the annular array of bubble-forming loops, so that bubbles are blown outwardly of the loops, in the construction illustrated in FIGS. 14 and 15 the annular array of bubble-forming loops are located within the annular array of the nozzles so that the bubbles are blown inwardly of the loops.

Thus, in FIGS. 14 and 15 the container 810 is also divided into a plurality of sections by radial partitions 810*a*-810*d*. Also, the annular array of axial bores 831-834 and nozzles 831*a*-834*a* are formed in an outer cylinder 823 fixed to the bottom wall of the container 810 and circumscribe the annular array of bubble-forming loops 841-844 carried by the cylinder 820. Cylinder 820 is moved from its lower position, wherein the loops are submerged in the bubble-forming liquid of color in its respective section of the container, to the upper position shown in broken lines in FIG. 14 in alignment with the nozzles in the outer cylinder 823. As shown particularly in FIG. 15, the nozzles and loops are both angled (e.g., 30°-60°) with respect to the longitudinal axis of the container.

The arrangement in FIGS. 14 and 15 is such that the air from each nozzle, when its respective control valve is opened, is directed inwardly (rather than outwardly) towards the respective bubble-forming loop so as to produce bubbles moving in the inward direction at an angle to the longitudinal axis of the container. This arrangement thus causes the produced bubbles to conglomerate, when a plurality of bubbles are produced at about the same time, thereby enabling the user to produce a wide variety of colored bubble patterns. The construction and operation of the FIGS. 14 and 15 device are otherwise as described above with respect to FIGS. 12 and 13.

FIG. 16 illustrates another construction of bubble-producing device for producing multi-colored bubbles. The device illustrated in FIG. 16 also includes a container 910 divided by a plurality of partitions 910*a*-910*d*, into a plurality of sections each adapted to receive a bubble-forming liquid of a particular color. In this case, however, the plurality of sections are of an annular configuration and are arranged coaxially to each other and to a central stem 930 fixed to the bottom of container 910 and formed with an axially-extending bore 931 terminating at its upper end in air nozzle 931*a*.

Each of the sections within container 910 includes five cylinders 921-925 fixed to the bottom wall of the container. Each cylinder receives a piston 926-929*a* carrying a bubble-forming loop 941-945 at its upper end such that in the lower position of the loops (as shown in full lines), they are submerged in the colored bubble-forming liquid in their respective section.

The five pistons 926-929*a* define, with their respective cylinders 921-925, five expansible chambers 932*a*-932*e* connectable by a plurality of tubes, generally designated 953, and a control panel 952 to manual pump 950. The pistons are normally urged downwardly to contract their respective chambers by coiled springs 936*a*-936*e* within each cylinder, but are moveable upwardly by the introduction of a compressed gas into their expansible chambers 932*a*-932*c*, from pump 950 as controlled by control panel 952.

It will thus be seen that the five bubble-forming loops 941-945 are arrayed along a radial line aligned with each other, and with the axis of nozzle 931*a* in the central stem 930. Thus, when a selected one or ones of the bubble-forming loops are moved to their upper positions, shown in broken lines in FIG. 16, emerged from the colored bubble-forming liquid in their respective section, each is aligned with air nozzle 931*a* in the central stem 930. Air nozzle 931*a* is also connected to the pump 950 via tube 953*a* and the control panel 952.

As further shown in FIG. 16, the control panel 952 includes a control valve ($CV_1$-$CV_5$) for each of the tubes leading to the five expansible chambers 932*a*-932*e*, and a drain valve $DV_1$-$DV_5$ upstream of each control valve for the respective tube. Control panel 952 further includes a further control valve ACV in line 953*a* leading to bore 931 and its air nozzle 931*a*, in the fixed central stem 930.

It will thus be seen that, in the normal condition of the bubble-producing device illustrated in FIG. 16, all the control valves and drain valves in the control panel 952 are closed, and all the bubble-forming loops are in their lower positions submerged within the colored bubble-forming liquid in their respective sections of the container 910. It will also be seen that air nozzle 931*a* is disconnected from the pressurized air produced by pump 950.

Whenever a bubble of the selected color is to be produced, the control valve $CV_1$-$CV_5$ for the respective bubble-forming loop is manually moved to its open position, to thereby cause the respective loop to rise to its upper, emerged condition, shown in broken lines in FIG. 16, so as to be aligned with air nozzle 931*a*. Then control valve ACV in line 953*a* is opened to direct air from nozzle 931*a* to the emerged bubble-forming loop, or loops, thereby producing a bubble of the respective color(s).

It will thus be appreciated that: the color of each produced bubble will depend on the control vale $CV_1$-$CV_5$ depressed; the size of each produced bubble will be dependent on the degree and time duration of opening of the control valve ACV, as well as the squeezing pressure applied to the pump 50; and the frequency of bubble production will depend on the frequency at which control valve ACV is opened and closed.

Whenever the actuated liquid-producing loop 941-945 becomes depleted of its liquid, the drain valve $DV_1$-$DV_5$ for the respective loop may be opened and thereby lower the loop back to its lower position submerged in the liquid within its respective section of the container. The respective control valve $CV_1$-$CV_5$ may then be opened to return the loop to its raised position emerged from the liquid and in alignment with nozzle 931*a* for producing further bubbles from the air issuing from the nozzle under the control of its control valve.

Whenever a different colored bubble is to be produced, the previously-raised loop may be lowered by its drain valve as discussed above, and another loop may be raised by opening its respective control valve so as to be in alignment with air nozzle 931*a*, and thereby to cause the device to produce bubbles of the respective color of the so-raised loop. It will be further appreciated that more than one loop may be raised at one time to be in alignment with nozzle 931*a*, to produce composite bubbles from the plurality of raised loops.

It will thus be seen that a great variety of different bubble colors and patterns may be produced by controlling the control valves and drain valves in control panel 952. While FIG. 16 illustrates only a single radial line of bubble-forming loops to be selectively aligned with a single air nozzle 931*a* in one quadrant of the container 910, it will be appreciated that the arrangement illustrated in FIG. 16 can be repeated in the other three quadrants of container 910, as shown for example in FIGS. 12-15, and thereby further multiplying the types of patterns of colored bubbles producible by the device. Also, the upper edges of the partition on the side of the receptacle opposite to those occupied by the loops could be formed with shaped enlargements for removably receiving the outlet end of a funnel, or could be even be integrally formed with funnels themselves, for refilling each section with its respective closed bubble-forming liquid.

Other Variations

In all of the above-described embodiments of the invention, the bubbles are blown by air introduced directly from a hand pump into the device via a control panel. Except for the embodiments of FIGS. 1-8, such an arrangement requires the user to use one hand for operating the pump, and the other hand for operating the control panel.

Figure 17:
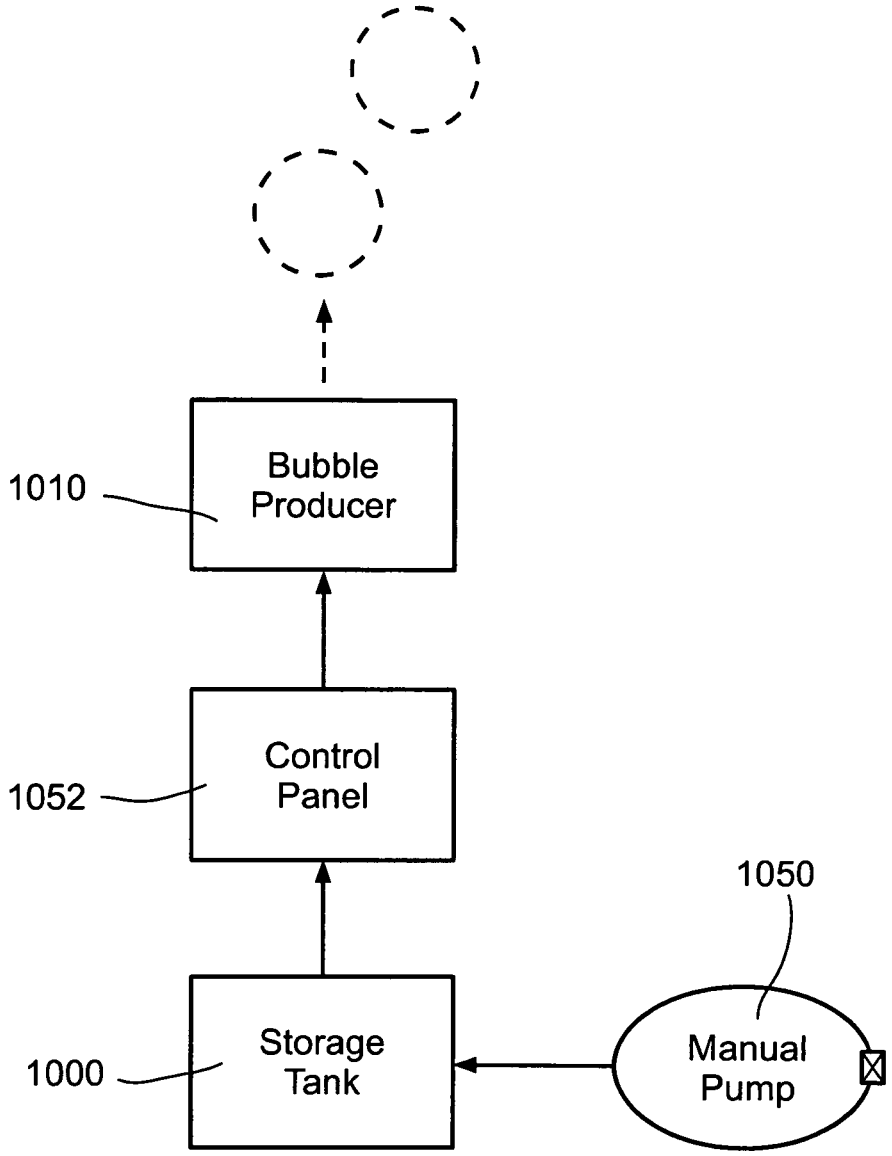
FIG. 17 illustrates the inclusion of a pressure tank in the bubble-producing device, in any of the foregoing embodiments, to enable the device to be initially pressurized such that manual pumping is not needed for each operation, thereby permitting the various control devices to be more conveniently used as and when needed for bubble production.

FIG. 17 illustrates a variation applicable to all the above-described embodiments, wherein a storage tank 1000 is interposed between the pump 1050 and the manual control panel 1052 leading to the bubble producer container 1010. In such a modification, the pump 1050 may be hand operated to pressurize the air within the storage tank 1000 to a desired level, and then the control panel 1052 may be used for controlling the air flow with respect to the bubble-producer container 1010, thereby relieving the user from the need to hand-operate the pump 1050 during the production of the bubbles. Thus, once the storage tank 1000 has been pressurized by manual operation of the pump 1050, operation of the pump is no longer needed, so that only one hand, or both hands, may be used to control the production of bubbles by operating the various controls in control panel 1052.

The storage tank could be vented to the atmosphere whenever desired, by merely depressing both the drain valve DV and the control CV for any section of the container. Alternatively, a special drain valve could be provided on the storage tank or control panel 952 upstream of all the control valves.

Also, while the invention has been described with respect to several preferred embodiments, it will be appreciated that these are set forth merely for purposes of example, and that many other variations may be made. For example, the device could use different loop shapes, instead of different colors, in which case the container would not have to be separately sectioned. Further, the arrays of loops could be of a different number, e.g. an annular array having three loops arranged in a triangle, or six loops arranged in a hexagon. In addition, the bulb 50 (or the storage tank 1000, FIG. 17) may be constructed to receive one or more ice cubes to cool and moisturize the air pumped to each loop in order to lengthen the life of the bubbles produced therein. Also, the bubbles produced may be used as targets for other toys, such as those launching soft spongy balls, suction darts, and the like.

Another type of manually-operated pump 50 may be used, such as a plunger type, a trigger type, or a bellows type; electrically-operated pumps or blowers may also be used. The bubble-producing device may be connected to other sources of air, such as a mouthpiece to be inserted into the user's mouth, or to another source of compressed air or other gas, e.g., helium. The air supply, or air path leading to it, may include a restrictor, fixed or variable, for restricting the rate of flow of the air into the loop. The variable-shaped loop illustrated in FIGS. 5-7*d* may also be used in other types of bubble-producing devices. Also the container, or an outer housing for the device, may be shaped to be hand-held or to simulate the appearance of an animal or other object so as to be attractive to children, and the manual pump may be in the form of a finger-trigger or bellows associated with the hand-held device.

Many other variations, modifications and applications of the invention will be apparent.

What is claimed is:

1. A bubble-producing device, comprising:

a container for receiving a quantity of a bubble-forming liquid to a desired liquid level in the container;

a bubble-forming loop moveable within said container to a lower position below said desired liquid level so as to be submerged in the liquid when received within the container, or to an upper position emerged from said liquid;

and a controlled gas supply system including a source of pressurized gas remotely located from said container and bubble-forming loop, a flexible supply line connecting said remotely-located source of pressurized gas to said container, and a control device proximal to said remotely-located source of pressurized gas for controlling the introduction of pressurized gas from said source into said container effective: (a) first to move said bubble-forming loop from its lower position submerged in said bubble-forming liquid, to its upper position emerged from said bubble-forming liquid; and then (b) to discharge gas through the bubble-forming loop and thereby to produce a bubble therein, wherein said device further comprises an expansible chamber in said container defined by a piston coupled to said bubble-forming loop displaceable in a cylinder having one end connected to said source of pressurized gas and formed with a grooved inner surface at its opposite end such that when said gas is introduced into said expansible chamber, said displaceable piston is displaced from said one end of the cylinder to move said bubble-forming loop to its upper position above the liquid in the container and into said opposite end, whereupon the grooved inner surface of the cylinder discharges gas through said bubble-forming loop to produce said bubbles therein.

2. The device according to claim 1, wherein said source of pressurized gas of said controlled gas supply system includes a manually-actuated pump for introducing a gas into said container.

3. The device according to claim 2, wherein said source of pressurized gas of said controlled gas supply system further includes a storage tank between said manual pump and said container for storing compressed gas before introduced into said container.

4. The device according to claim 1, wherein said control device includes a first manually-operable member for moving said bubble-forming loop from its lower position submerged in said bubble-forming liquid to its upper position emerged from said bubble-forming liquid; and a second manually-operable member for producing gas discharges through said bubble-forming loop.

5. The device according to claim 1, wherein said container is divided into a plurality of sections for receiving differently-colored bubble-forming liquids, and wherein said device further comprises a plurality of bubble-forming loops each moveable to a lower position within one of said sections so as to be submerged in the colored bubble-forming liquid therein, and to an upper position so as to be emerged from the liquid in the respective section.

6. The device according to claim 5, wherein said plurality of bubble-forming loops are arrayed in a linear array, and said controlled gas supply system includes at least one nozzle aligned with said linear array of loops when in their upper positions.

7. The device according to claim 5, wherein said plurality of bubble-forming loops are arrayed in an annular array, and said controlled gas supply system includes an annular array of nozzles each aligned with one of said bubble-forming loops when in its upper position.

* * * * *